United States Patent [19]

Massaro

[11] Patent Number: 4,885,731

[45] Date of Patent: Dec. 5, 1989

[54] CHILD'S EASY-TO-READ TIMEPIECE

[76] Inventor: Dominic W. Massaro, 617 Arroyo Seco, Santa Cruz, Calif. 95060

[21] Appl. No.: 314,401

[22] Filed: Feb. 23, 1989

[51] Int. Cl.[4] ..... G04B 19/04

[52] U.S. Cl. ..... 368/228; 368/223; 368/238

[58] Field of Search ..... 368/238, 228, 223

[56] References Cited

U.S. PATENT DOCUMENTS

| | | | |
|---|---|---|---|
| D. 54,950 | 4/1920 | Montgomery . | |
| D. 166,239 | 3/1952 | Berman . | |
| 908,964 | 11/1908 | Ferguson . | |
| 1,192,811 | 7/1916 | Borresen | 368/238 |
| 1,476,749 | 12/1923 | Yoemans | 368/228 |
| 1,650,123 | 11/1927 | Gritton . | |
| 3,849,980 | 11/1974 | Laesser | 58/58 |
| 4,413,915 | 11/1983 | Besson | 368/71 |
| 4,483,628 | 11/1984 | Terzian | 368/82 |

FOREIGN PATENT DOCUMENTS

| | | | |
|---|---|---|---|
| 0642387 | 8/1928 | France | 368/238 |

*Primary Examiner*—Bernard Roskoski

[57] ABSTRACT

An analog timepiece face that contains a smaller hour portion (A) concentrically positioned within a larger minute portion (B). The hour portion has a hour hand (C) and hour division marks (F) marking each interval of time on the peripheral hour track (E). The minute portion has a minute hand (G) and minute division marks (J) marking each interval of time on the peripheral minute track (I). Hour numerals (D) and minute numerals (H) are provided on the respective hour and minute tracks of the timepiece. Spatial location, size, type font, and color are used to key the components of one portion together and to keep the hour and minute portions distinct from one another. The hour and minute hand are made to differ in spatial location, size, and color. The hour numerals and the minute numerals are made to differ in spatial location, size, and color. In addition, correlated visible cues of spatial location, size, and color are used to specify the correspondence between the hour hand and the hour numerals and the minute hand and the minute numerals. the proposed timepiece can also include a digital portion (M) placed near the center. The correspondence between the analog and the digital representations of time is highlighted by making the size, font, or color of the digital numbers the same as the size, font, or color of the corresponding numbers on the analog clock. In addition, an analog timepiece with a clockface with at least one elongated hand that is made translucent to preclude the occlusion of numerals on the clockface.

18 Claims, 3 Drawing Sheets

CHILD'S EASY-TO-READ TIMEPIECE

BACKGROUND

1. Field of Invention

This invention relates to timepieces, specifically to an improved design for clocks and watches to be used by children and mentally-disadvantaged individuals.

2. Description of Problem

The representation, measurement, and communication of time are central to our everyday life. Until recent years, most time has been recorded by analog timepieces, which are traditional devices with minute and hour hands that move in a clockwise direction around a circular face. The analog clock is a legacy of history and represents the available technology at the time, rather than a principled device that was designed to convey time in a rational manner. The analog clock is thus an arbitrary, but standardized device, that must be learned and mastered. Therefore, one of the most important skills acquired in the first years of schooling is the ability to tell time. However, it is wellknown that children have great difficulty in learning to tell time, especially analog time. Even after children are able to tell time, several years of experience are necessary before time-telling becomes an easy and automatic act. Furthermore, some mentally-disadvantaged individuals never learn to tell analog time or always have great difficulty telling the time from an analog clock.

Time-telling remains a hurdle for children primarily because the traditional analog clock is poorly designed and little effort has been directed at improving the design of analog timepieces. In fact, the modern clocks and watches being sold and used have, for the most part, sacrificed functional design for the sake of style. The marketplace is being flooded with clocks and watches with no or few numbers, with upside down numbers, or with irrelevant artistic drawings that impede the process of telling time.

Digital timepieces, which give a direct indication of the time, were introduced in this century. Digital timepieces are easy to read and reduce the time and effort required for learning. The representation of time on a digital timepiece is identical to the representation of time in writing. Advances in the technology of electronics during the 1970's made these watches as affordable as analog timepieces. When a mother leaves a note for her child to be home for dinner at six fifteen, she writes the time as 6:15. She does not draw an analog clock with the hour hand on the six and the minute hand on the three. If the child knows how to read the representation of time in writing, then he or she essentially knows how to tell time on a digital timepiece. Digital time is easier to read because merely knowing the names of the appropriate digits and the separation function of the colon are the only skills needed. The child does not need to know how to map the hands of the analog timepiece into hours and minutes. Given the availability and use of digital timepieces, many children do not master the telling of analog time until after adolescence.

VALUE OF ANALOG CLOCKS

Rather than improving the design of analog clocks, their replacement with digital clocks might be suggested. However, there are several important reasons why it is unlikely that analog timepieces will be replaced with digital timepieces. First, analog timepieces are meaningful and highly valued by most individuals and societies and, most likely, the use of analog clocks will remain central to time telling. The main feature of clocks, whether analog or digital, is the measure of time or duration. A timepiece is based on the principle of equating a spatial distance (the movement of the earth around its axis of rotation) with an interval of time. This correspondence between time and spatial distance is more apparent in analog than in digital clocks.

Second, the use of analog time has intellectual benefits that are not available with digital time. Once we learn to read an analog clock, our understanding of time is advanced beyond a mere understanding of digital time. Seeing an analog clock which indicates a time of 3:58 will not only indicate that a long period has elapsed since 3:00, but will also inform the perceiver that it is very close to 4:00—something not contained in the digital representation of time. Reading an analog clock at two successive times also permits a more direct estimate of how much time has elapsed between the two readings. There is some evidence that an understanding of analog time facilitates the learning and understanding of other subjects, such as arithmetic. For example, learning about the analog representation of number in analog clocks facilitates the child's acquisition of a number's cardinality—a representation of the meaning of a number as an integral and separable quantity, as opposed to something that is obtained by simply counting to it.

A third advantage is that analog timepieces can be more functional than digital timepieces in some situations and with some individuals. Analog clocks can be read at great distances or under poor illumination—conditions that would make it difficult to read the numbers of digital clocks. Some partially-sighted persons can tell time on analog watches, but not on digital watches. For these individuals, the numbers on digital watches are much too small to read. In fact, most adults who require glasses for reading cannot read digital watches without their reading glasses. Thus, analog timepieces are functional in situations in which digital timepieces are not because adults can read analog time fairly accurately without any external representation of digits. Simply knowing the location of the hands is sufficient to know the approximate time. In fact, the minute hand on an analog watch is often redundant in that simply locating the hour hand is sufficient for a fairly accurate estimate of time.

LIMITATIONS OF TRADITIONAL ANALOG CLOCKS

Notwithstanding the importance of analog time, the traditional analog clock is inherently poorly designed and very little effort has been made to improve the design of analog timepieces. The design of the analog clock is standardized but arbitrary. There is no natural mapping between a setting of the clock and the time. That is, there is very little information in a setting of the analog clock that specifies the time. When an analog clock is set at 3:10, for example, it could be mistakenly read as 2:15 by confusing the hour and minute hands. The analog clock set at 3:10, might also be read as 3:02 by reading the numeral pointed to by the minute hand rather than calculating that it is 5 times the value of the numeral. Finally, the analog clock set at 3:10 might also be read as 2:03 by confusing the hour and minute hands and by reading the numeral pointed to by the hand believed to be the minute hand.

The poor design of analog clocks is most apparent when they are contrasted with digital clocks. With analog time, the time is not specified by the clock as it is with digital time. With a digital clock, reading the numbers gives the time. In contrast, the numbers on the analog clock refer only to the hour hand. There are no analogous numbers for the minute hand. One of the child's primary confusions is to use the numbers on the analog clock to indicate the minutes. Seeing the "big" hand on the 2, for example, the child reads the time as 2 past the hour rather than 10 past the hour. To master the telling of analog time, the child has to overcome the conflicting information given by the hour numbers in the reading the minutes. There is good evidence that people find it difficult to make a response that conflicts with their current perception. Some of the evidence comes from a well-known phenomenon in psychology known as the Stroop color-word task. People have tremendous difficulty in naming the color of the print of a word that happens to be a color name. People are essentially tongue-tied when they are asked to name the color of the word blue printed in red ink.

Children confuse the hour and minute functions because these functions are not kept independent of one another on traditional analog clocks. Children need to learn and remember that the little hand refers to the hour and that the big hand refers to the minute. They must also learn and remember that the numbers on the clock refer to the hour and not to the minute. They must learn and remember that the minute is given by distance of the minute hand around the circumference of the clock—the number of minute divisions past 12 o'clock.

Rather than counting the number of minute divisions, the children are taught to count by fives for each number past 12 o'clock. This later activity is not only difficult, it requires the child to carry out an unnatural act—calling the number 1 "five", the number 2 "ten", and so on. As described earlier in the discussion of the Stroop color-word phenomenon, people have great difficulty making a response different from that specified in the stimulus being read. In addition, the child is learning an inappropriate method of reading numbers, which could negatively transfer to arithmetic and other activities with numbers. That is, a 1 is a "one" and we should not be teaching our children to call it "five".

DESCRIPTION OF PRIOR ART

Several improvements of analog clocks have been discussed and used. One traditional design helped segregate the minute and hour functions. The face of the clock contained both a smaller hour portion and a larger minute portion so that both minute and hour numbers were provided on the face of the clock. The hour numbers were placed along a circular or elliptical track centered within a circular or elliptical track holding the minute numbers. Usually, the hour numbers would be written in Roman numerals I through XII and the minute numbers would be written in Arabic numerals 5 through 60 in steps of 5. However, there was a haphazard relationship between the relative sizes of the minute and hour numbers—usually with the hour numbers made significantly larger than the minute numbers. More importantly, there was no consistent correspondence between the physical characteristics of the hour and minute hands and the corresponding characteristics of the minute and hour numbers. That is, nothing in the physical makeup of these clocks specified which hand should go with which numbers—other than the spatial location of the tip of the hand.

At the turn of this century, there was some effort directed at improving the standards of railroad watches. After several major accidents, much effort was directed at designing better watches for engineers and timekeepers. In addition to designing watches that kept accurate time and that would remind the user to keep it wound, one goal was to minimize any misreading of the watch. As stated by Webb C. Ball, a jeweler often given credit for originating the idea of standards for railroad watches, ". . . dials that give the hour and minute without any confusion of fantastic figures or freakish designs." (*Railway Age,* Oct. 8, 1920). Ball advocated watches that had only hour numerals "that should be plain upright Arabic figures to indicate the hour points . . . with the intermediate minute dashes . . . distinct for easy reading." These watches included a clock measuring seconds with its own hand and numerals and placed below the center of watch. Ball also cautioned against the use of what he considered to be confusing or freakish dials. For Ball, freakish dials were nothing more than slight variations of traditional clocks having both hour and minute numerals placed on the clockface. The typical modification was to make all of the numerals Arabic rather than to use Roman numerals to give the hour. In addition, the minute numbers were usually considerably smaller than the hour numbers.

One design which had Arabic hour numerals within Arabic minute numerals was disclosed in U.S. Pat. No. 903,964 by L. B. Ferguson (1908). Ferguson'goal was to direct attention to the minute clock because minutes were more important for railroad timekeepers and because he believed that these workers would always have the hour in mind. That is, most adults and particularly railroad employees were expected to know the current hour. Therefore, Ferguson's goal was to eliminate the detrimental influence of the hour clock on the reading of the minute clock. Thus, he made the hour numbers very small and faint. These characteristics would accomplish his intent but would also work against an accurate reading of the hour clock, especially by children. Ferguson's rationale for his design can be criticized and it certainly does not hold for children, who do not know the current hour any better than the current minute. Children need to attend equally to the hour and to the minute. Ferguson's goal was simply to design a timepiece in which the minute clock would dominate the hour clock, but his timepiece did not facilitate determination of the hour and the minute, without any confusion between them. In fact, Ferguson placed both large and small minute numerals in the periphery and, therefore, violated any correspondence between the size of the minute hand and the size of the minute numerals. Sometimes the minute hand would point to big numbers and sometimes it would point to little numbers. Given this lack of correspondence with the clock face shown by Ferguson, a child could not be instructed that the big hand goes with the big numbers. Furthermore, the minute hand shown by Ferguson did not appear to be noticeably wider than the hour hand—although the two hands did differ significantly in length. Thus, with the clock face shown by Ferguson, a child instructed that the big hand goes with the big numbers might have difficulty seeing which hand is the big hand.

An analysis of these patents suggests that these inventors did not anticipate the value of keeping the physical characteristics of the hour and minute portions of the clockface equally visible but also distinct from one another. In fact, the ornamental design U.S. Pat. No. D268,110, issued to Henry S. Montgomery in 1918, shows a complete disregard for keeping the two portions distinct from one another. The hour and minute numerals were designed to be roughly the same size and the hour hand extended well beyond the hour numerals into the region of the minute numerals. Even so, the design by Montgomery, known as the Montgomery dial, became an accepted railroad watch and has been used up to the present time. The design also became popular for men's commercial watches. In a similar disregard for keeping two portions of a clock distinct from one another, Yeomans (U.S. Pat. No. 1,476,749, 1923) designed a clock with two portions that had red and black hands that corresponded to red and black numerals placed on two separate tracks, respectively. However, the red and black hands were exactly the same size and pointed to the same spatial location on the periphery. Thus, this clockface would be difficult to read accurately and quickly because the red hand points to the black numerals and not to the red numerals. In addition, the numerals of the two clocks were specified to be the same size. A child would confuse the two portions of the clock because the numerals would be the same size.

A U.S. Pat. No. D166,239 was issued to Hymie D. Berman (1952) for a toy teaching clock in which very large hour numerals were placed inside very small minute numerals. In this case, a large minute hand was meant to correspond to small hour numerals—an unnatural correspondence between the hour hand and the hour numerals. The inconsistent mapping between a large minute and small minute numerals would make it difficult to learn and master the correspondence between the minute hand and minute numerals. In addition, the tip of the hour hand in Berman's design extended well beyond the location of the minute numerals. The distance between the tip of the minute hand and the minute numerals is about as large as the distance between the tip of the hour hand and the minute numerals. Given the mismatch between the size and location of the minute hand and the size and location of the minute numerals, children would not have any physical characteristic that would specify the correspondence between the minute hand and minute numerals. The limitations in Berman's design would not only make it difficult for children to learn to tell time, it would provide little positive transfer from learning and mastery of his educational clock to a traditional clock.

A consistent property of all of previous clocks that provide separate hour and minute portions is the minute numerals go from 5 to 60 in steps of 5. However, it can be argued that it is inappropriate to pair the hour numeral 12 with the minute numeral 60. The minute hand pointing straight up in the traditional location of the 12 specifies 0 minutes past the hour currently indicated by the hour hand, not 60 minutes past this hour. For example, 2:00 is given by the hour hand on 2 and the minute hand on 12. If the minute hand on 12 meant 60 minutes past the hour, then it should be 60 minutes past 2 when it is actually 2:00.

OBJECTS AND ADVANTAGES

Accordingly, one principal object and advantage of the invention is to provide a clock which enables children and mentally-disadvantage persons to learn to tell analog time and use it as easily as possible. Another advantage is to reduce the many hours of classroom instruction and homework currently devoted to telling analog time so that this time could be profitably spent on the teaching of other necessary skills and cultural knowledge. For the objects are to provide a timepiece that makes the telling of analog time easy to learn and use, by employing a design based on principles of psychology, cognitive engineering, and observational and experimental evidence.

The goal of the proposed design of an analog timepiece is to provide a good mental model of the clock for the child since there is evidence that people learn to use devices more readily if they have the appropriate conceptual or mental model of how the thing works. With respect to clocks, the child's mental model is his or her understanding of how a clock represents the time. The appropriate mental model will be specified in the visible structure of the proposed timepiece. The understanding via the mental model derived from the visible structure will facilitate learning and remembering how to tell time.

Additional objects and advantages of the present invention are:

(a) to segregate the hour and minute functions in order to minimize the confusion between them;

(b) to provide a more natural mapping between the hands off the clock and the corresponding periphery, division marks, and numerals;

(c) to provide redundant information that will make the telling of time easier and more accurate;

(d) to insure that a greater proportion of people learn to read and use analog clocks;

(e) to change the learning experience of the child from negative to positive by eliminating the vast amount of initial failure associated with learning to tell time;

(f) to allow the child to transfer their learning to read traditional analog clocks.

Further objects and advantages will become apparent from a consideration of the ensuing description taken in conjunction with the accompanying drawings.

DRAWING FIGURES

SUMMARY

In accordance with the present invention I provide a clockface that segregates the minute and hour functions to reduce any confusion between them. In addition, the invention provides a more natural mapping between the information on the clock and the current time. The minute and hour hands are made to differ in spatial location, size, and color. Both minute and hour numbers are provided on the proposed clock. The minute and hour numbers are made to differ in spatial location, size, and color. Most importantly, correlated visible cues are used to convey the correspondence between the hour hand and the hour numbers and the minute hand and the minute numbers. A small red hour hand goes with the small red hour numbers near the tip of the hour hand. A large green minute hand goes with the large green minute numbers near the tip of the minute hand. Thus, the child will see directly what numbers go with what hand because spatial location, size, and color agree. Preliminary experiments with this clock show that children easily understand the appropriate correspondence between the hands and numbers. In addition, they find it easy to read both the hour and minute numbers.

The clock of the invention also provides redundant information on the clockface that makes the telling of time easier and more accurate. There is experimental evidence that human performance improves with increases in redundancy. Consider a task in which a person must determine whether two objects are the same or different from one another. The time it takes to make this decision decreases with increases in the number of dimensions that differ. A difference between two objects differing in size and color is noticed and reacted to more quickly than a difference between two objects differing in only one of these dimensions. The redundancy in the current disclosure centers around the use of several dimensions to convey the correspondence between each hand and the relevant numbers on the clock. Spatial location, size, and color are used to convey this correspondence. Using the same logic, these three dimensions are also used to keep the hour hand and hour numbers distinct from the minute hand and minute numbers. In addition, differences in type font are used to keep the hour numbers distinct from the minute numbers.

It should be stressed that the invention improves on the design of traditional clocks rather than offering an alternative to it. The reason is that we want the child to transfer their learning with the improved design to the use of traditional clocks. Mastering time telling with the current design will allow the child to acquire the appropriate mental model of an analog timepiece. This mental model will make it possible for the child to transfer their learning to traditional clocks. The better design of the proposed clock will insure that a greater proportion of people, such as mentally-handicapped persons, learn to read and use analog time.

DESCRIPTION—FIG. 1

Figure 1:
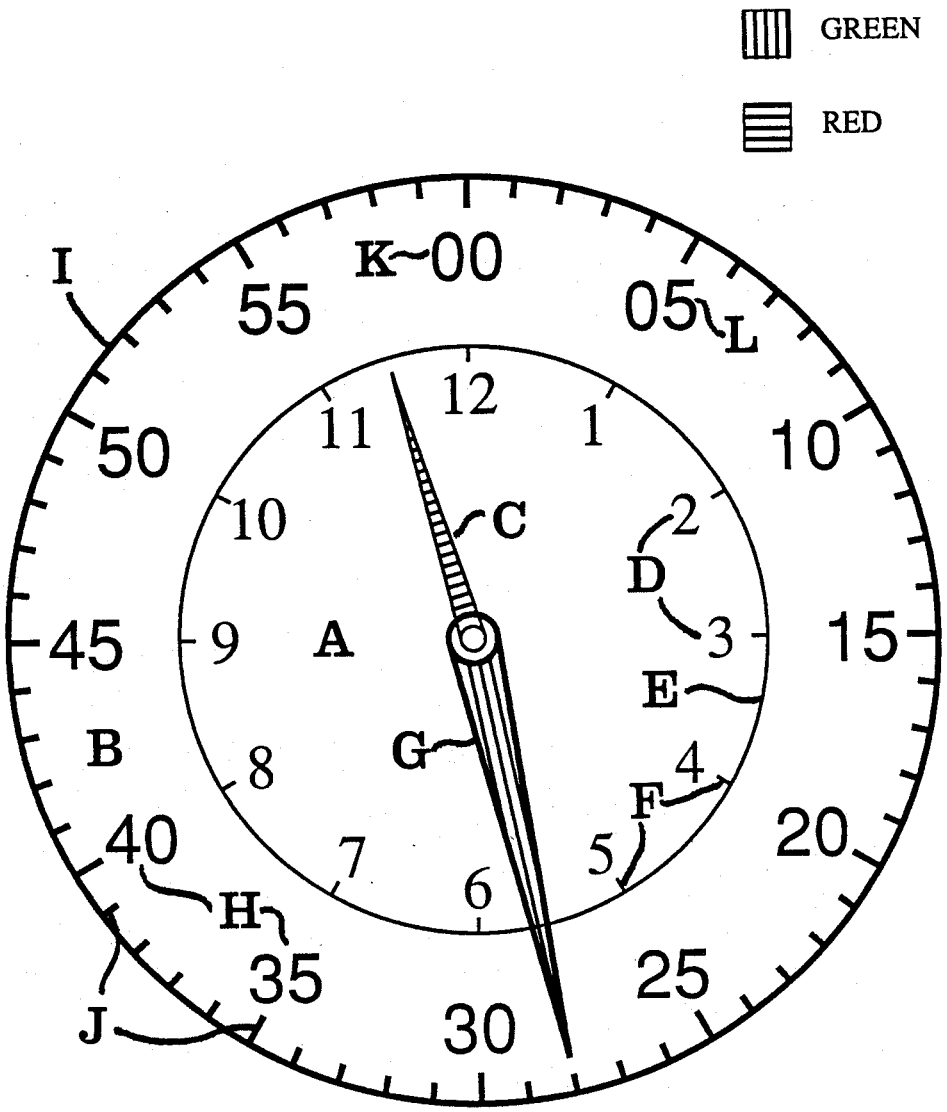
FIG. 1 is an isometric view of the face of an analog timepiece embodying the invention.

The face of a clock according to a preferred embodiment of the present invention is illustrated in FIG. 1. The timepiece contains a clock mechanism of any preferred from—either mechanical, electrical, or electronic. Because such mechanisms are well known, the one used in FIG. 1 is not specifically illustrated, but can be an electric motor with the usual gears. The face contains a smaller hour portion A concentrically positioned within a larger minute portion B. In this embodiment, spatial location, size, type font, and color are used to keep the hour and minute clocks distinct from one another. The proposed design segregates the minute and hour functions to reduce any confusion between them. In addition, it provides a more natural mapping between the information on the clock and the current time.

The minute and hour hands are made to differ in spatial location, size, and color. Both minute and hour numerals are provided on the proposed clock. The minute and hour numerals are also made to differ in spatial location, size, type font and color. Most importantly, correlated visible cues are used to convey a correspondence between the hour hand and the hour numerals and the minute hand and the minute numerals. As indicated by the color shading legend, the hour hand C is red and this correlates with small numerals, near the tip of the hour hand, which are also red (shading not provided due to the small size of numerals). The large minute hand G is green, as indicated, and thus is correlated with the large numerals, near the tip of the minute hand, which are also green (shading not provided). Thus, the child will see directly what numerals go with what hand because spatial location, size, and color agree. There is good evidence that children distinguish spatial location, size, type font, and color and can use these dimensions to guide behavior.

The hour portion is made small and the minute portion is made large because the hour hand is smaller than the minute hand in traditional clocks. The smaller clock at the center is characterized by a small hour hand C, small hour numerals D, a circular hour track E around the hour numerals and small division marks F on the inside of the hour track at each hour. The larger clock at the periphery is characterized by a large minute hand G, large minute numerals H, a circular minute track I around the hour numerals, and large division marks J on the inside of the minute track at each one-minute location.

To add to the correlation of the components within the hour clock, the hour track (shading not indicated) and the hour division marks (shading not indicated) are made the same color as the hour hand and hour numerals. Similarly, the minute track (shading not indicated) and the minute division marks (shading not indicated) are made the same color as the minute hand and minute numerals. Thus, the differences between the hour and minute clocks are highlighted because the minute and hour components are in different colors. The hour hand, hour numerals, hour track, and hour division marks are keyed together by making them one color and the minute hand, minute numerals, minute track, and minute division marks are keyed together by making them another color.

In the embodiment shown, the minute components are green and the hour components are red. The child will find it easy to learn that the large green numbers, the large green circle, and the large green division marks go with the large green hand and the small red numbers, the small red circle, and small red division marks go with the small red hand. Finally, the difference between the hour numbers and minute numbers is accentuated by printing them in different type fonts, as illustrated.

In previous clocks that provide separate hour and minute portions, the minute divisions are numbered from 5 to 60 in steps of 5 corresponding to the hour divisions numbered from 1 to 12 in steps of 1. However, it can be argued that it is inappropriate to pair the hour number 12 with the minutes number 60. The minute hand pointing straight up in the traditional location of the 12 specifies 0 minutes past the hour currently being indicated by the hour hand, not 60 minutes past this hour. For example, 2:00 is given by the hour hand on 2 and the minute hand on 12. If the minute hand on 12 means 60 minutes past the hour, then it should be 60 minutes past 2 when it is actually 2:00. To overcome this potential confusion, the minute numerals in the present design are arranged from 0, 5, through 55 in steps of 5 corresponding to the hour numerals 12, 1 through 11 in steps of 1.

An additional characteristic of the invention is that 0 is represented by 00 (K) and 5 is represented by 05 (L) on the minute portion to highlight the correspondence between the numerals and the spoken and written forms of the time. When a clock gives the time as five after 12, we say that it is "twelve-oh-five" and we write 12:05. The advantage of the invention over the traditional design is that the correspondences between the numerals and the reading of the time and the written representation of time is the same for times between the hour and ten past the hour as it is for all other times. Thus, the child will more easily understand the correspondence between the numerals and the time.

OPERATION—FIG. 1

Given the visible structure of the proposed clock, it is easy to give the child a mental model of how the clock works. The child can be told that a clock actually consist of two clocks—a minute clock and an hour clock. It is easy to see and to keep separate the two clocks in the present design. The child can be instructed that the large green numbers, large green circle, and large green division marks go with the large green hand and the small red numbers, small red circle, and small red division marks go with the small red hand. He or she is thus told to tell the time by first reading the small red number that goes with the small red hand as the hour and the large green number that goes with the large green hand as the minute.

DESCRIPTION—FIG. 2

Figure 2:
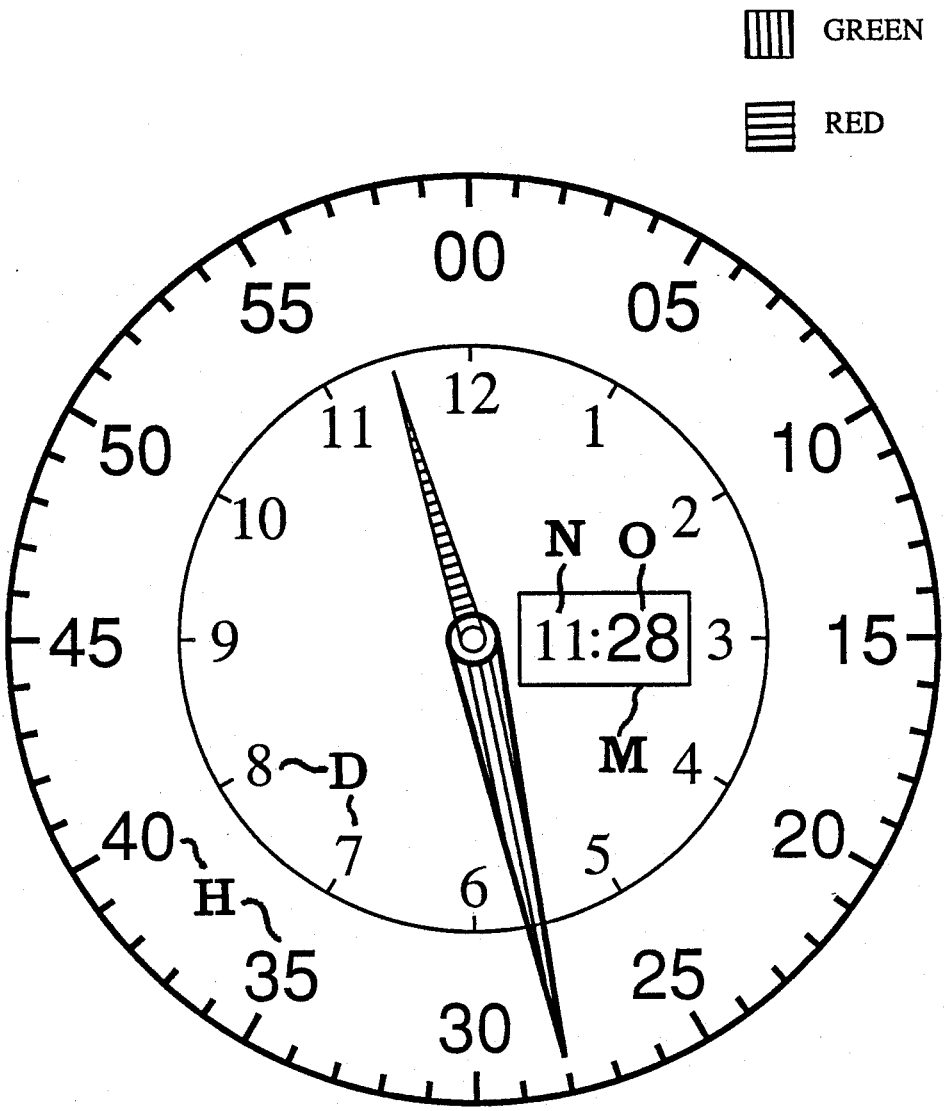
FIG. 2 is an isometric view of the face of an analog/-digital timepiece embodying the invention.

As described previously, a well-established fact about behavior is that people exploit the natural redundancy in the environment. Their performance in the context of two sources of information is better than in the context of just one source of information. For example, children identify an object more accurately if it is in color than if it is in black and white. Applying this principle to the telling of time justifies the design of an analog/digital timepiece that embodies the principles of the present invention. This clock is identical to the analog clock shown in FIG. 1, with the addition of a digital clock M placed to the right of the center of the timepiece, as shown in FIG. 2.

The central goal of this design is to illustrate the correspondence between a digital representation of time and an analog one. Reading this clock, the child will see both representations and will naturally learn their correspondence. The correspondence between the analog and the digital representations of time is highlighted by making the size, font, and color of the digital numbers the same as the size, font, and color of the corresponding numbers on the analog clock. Thus, the hour numbers N in the window of the digital clock are the same size, font, and color as the hour numbers D on the hour analog clock. Similarly, the minute numbers 0 in the window of the digital clock are the same size, font, and color as the minute numbers H on the minute analog clock.

OPERATION—FIG. 2

Given the visible structure of the proposed clock, it is easy to give the child a mental model of how the clock works. As in the operation of the analog clock, the child can be told that the large green numbers, large green circle, and large green division marks go with the large green hand and the small red numbers, small red circle, and small red division marks go with the small red hand. In addition, the child will now be told about the correspondence between the numerals on the digital clock and the numerals on the analog clock. The child will readily see the correspondence given the agreement in the size, font, and color of the numerals.

CONTROL OVER THE PRESENCE OF THE DIGITAL CLOCK

It is possible that the child will not learn to tell analog time with the current design for the analog/digital timepiece because he or she will attend to only the digital clock. To preclude this possibility, one variation of the current design (not shown) includes a mechanism to eliminate the appearance of the digital time by a push of a button. The button can either cause an opaque cover to be placed over the digital portion of the timepiece or simply remove the numerals in the digital portion of the timepiece.

DESCRIPTION—FIG. 3

Figure 3:
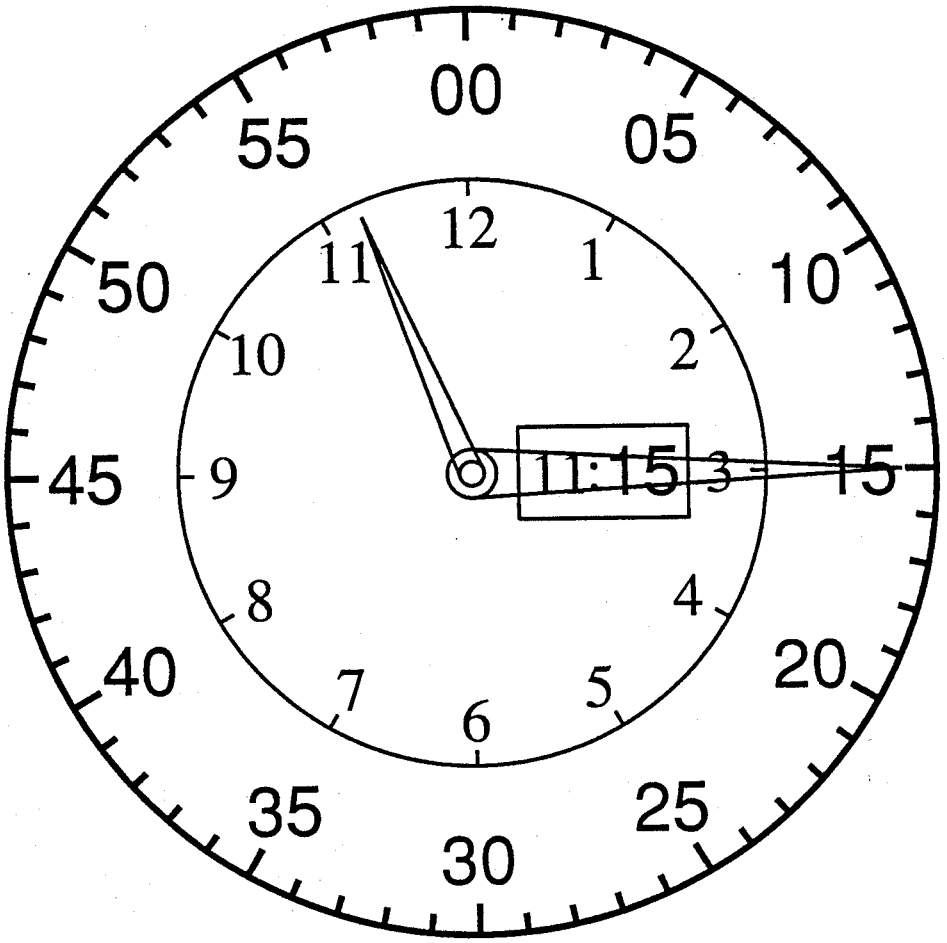
FIG. 3 is an isometric view of the face of the analog/-digital timepiece in which the hour and minute hands are made translucent.

One problem with conventional analog timepieces and with combination analog/digital timepieces is that the hands of the analog clock occlude the numerals on the clockface. To overcome this limitation, the embodiment of FIG. 3 is an analog/digital timepiece where the hands are made of a transparent material. This transparent property of the hands will eliminate as much as possible the occlusion of the hour numerals by the minute hand and the occlusion of the digital clock by both hands of the analog clock. In this case, it is possible to read the hour numeral and the digital clock, even when a hand is covering the hour numeral or the digital clock.

SUMMARY, RAMIFICATIONS, SCOPE

Thus the reader will see that I have provided analog clocks in which (a) the hour and minute functions are segregated in order to minimize the confusion between them; (b) a more natural mapping between the information on the clock and the current time is provided; (c) redundant information that will make the telling of time easier and more accurate is provided; (d) a greater proportion of people learn to read and use analog clocks; (e) the learning experience of children will be changed from negative to positive by eliminating the vast amount of initial failure associated with learning to tell time; (f) children will to transfer their learning and mastery of this improved design to read traditional analog clocks.

Other embodiments maintaining the spirit and scope of the invention are possible. For example, dimensions other than spatial location, size, font, and color could be used to keep the hour and minute functions distinct from one another. For example, the shape of the hands and numbers could be used in the same manner as size. Similarly, the brightness of the hands and numbers could be used in the same manner as color. In addition, the invention could be implemented in clocks with 24-hour time, clocks with 10 hour and 100 minute divisions, and clocks with rectangular faces, etc. Furthermore, the invention could be retrofitted to existing clocks. Therefore, this invention includes modifications that use only a subset of the visible dimensions considered here or ones that use different visible dimensions. Accordingly, the full scope of the invention should be determined only by the appended claims and have legal equivalence, rather than the examples and embodiments disclosed.

I claim:

1. An analog timepiece for indicating the time for use with children, mentally-disadvantaged persons, and the like comprising:

a clockface having a center portion and an outer portion, said outer portion surrounding said center portion, each of said portions having a series of spaced division marks and numerals around a periphery thereof, the division marks and numerals around said center portion representing successively cumulative intervals of one size, the division marks and numerals around said outer portion representing successively cumulative intervals of a different size, a pair of elongated hands, each of said hands having two opposite ends, one end of each hand being pivotably mounted in the center of said clockface, one of said hands being relatively short and the other hand being relatively long such that the other end of said short hand points to said division marks and numerals in said center portion and the other end of said long hand points to said division marks and numerals in said outer portion, and means for rotating said hands at different speeds such that said other end of each of said hands will move between adjacent division marks and numerals in its corresponding portion in respective time intervals of the size represented by such portion, each of said hands and its corresponding periphery, marks, and numerals of said clock face having at least two visual characteristics in common, each of said hands and its corresponding periphery, division marks, and numerals of said clockface having said at least two common visual characteristics different from those of the visual characteristics of the other of said hands and its corresponding periphery, division marks, and numerals.

2. The timepiece of claim 1 wherein said two common visual characteristics are size and color.

3. The timepiece of claim 1 wherein said numerals around said center portion representing successively cumulative intervals are 1 through 12 in steps of 1.

4. The timepiece of claim 1 wherein said numerals around said outer portion representing successively cumulative intervals are 0 through 55 in steps of 5, wherein 0 is represented as 00 and 5 is represented as 05.

5. The timepiece of claim 1 wherein the length and width of said short hand are seen as smaller than the length and width of said long hand.

6. The timepiece of claim 1 wherein the size of said numerals around said center portion is seen as smaller than the size of said numerals around said outer portion.

7. The timepiece of claim 1 wherein said periphery and said division marks marking each interval of time on the periphery of said center portion are of the same color as said numerals and said hand of said center portion.

8. The timepiece of claim 1 wherein said periphery and said division marks marking each interval of time on the periphery of said outer portion are of the same color as said numerals and said hand of said outer portion.

9. The timepiece of claim 1 wherein the color of said hands, said numerals, said periphery, and said division marks of said center portion is seen as different from the color of said hands, said numerals, said periphery, and said division marks of said outer portion.

10. The timepiece of claim 1, further including a third portion, said portion containing a digital clock having a left portion and a right portion, said portions being separated by a colon, each of said portions showing numerals, the numerals on said left portion representing successively cumulative intervals of one size, the numerals on said right portion representing successively cumulative intervals of a different size, the numerals on said left portion representing the time given by the said center portion of said analog clockface, the numerals on said right portion representing the time given by the said outer portion of said analog clockface, the numerals on said left portion and numerals of said center portion having at least two common visual characteristics, and the numerals on said right portion and numerals of said outer portion having at least two common visual characteristics different from that of said two common visual characteristics of the numerals on said left portion and numerals of said center portion.

11. The timepiece of claim 10 wherein said two common visual characteristics are size and color.

12. The timepiece of claim 10 wherein said two common visual characteristics are font and color.

13. The timepiece of claim 10 wherein said two common visual characteristics are size and font.

14. The timepiece of claim 10 wherein, in said clock, said numerals on said left portion represent hours and said numerals on said right portion represent minutes.

15. The timepiece of claim 10 wherein the size and color of the numerals of said digital clock are identical to those of the corresponding numerals on said analog clock.

16. The timepiece of claim 10 wherein the size and font of the numerals of said digital clock are identical to those of the corresponding numerals on said analog clock.

17. The timepiece of claim 10 wherein the color and font of the numerals of said digital clock are identical to those of the corresponding numerals on said analog clock.

18. The timepiece of claim 1 wherein at least one of said elongated hands is transparent so that it will not occlude said numerals on said clockface.

* * * * *